US006497270B1

(12) United States Patent
Breviere et al.

(10) Patent No.: US 6,497,270 B1
(45) Date of Patent: Dec. 24, 2002

(54) DEVICE FOR PRESSING A SIDE WALL IN INSTALLATION FOR CONTINUOUS CASTING OF METAL STRIPS BETWEEN TWO DRUMS AGAINST THE PLANAR SURFACES OF THE DRUMS

(75) Inventors: Yann Breviere, Ecquedecques (FR); Dominique Themines, Krefeld (DE); Jean-Michel Damasse, Dusseldorf (DE); Pierre Delassus, Bethune (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/856,307

(22) PCT Filed: Dec. 2, 1999

(86) PCT No.: PCT/FR99/02990

§ 371 (c)(1),
(2), (4) Date: Aug. 14, 2001

(87) PCT Pub. No.: WO00/32332

PCT Pub. Date: Jun. 8, 2000

(30) Foreign Application Priority Data

Dec. 3, 1998 (FR) ..... 98 15262

(51) Int. Cl.[7] ..... B22D 11/06; B22D 11/10

(52) U.S. Cl. ..... 164/428; 164/436; 164/480; 164/491

(58) Field of Search ..... 164/436, 481, 164/431, 432, 480, 491, 428

(56) References Cited

U.S. PATENT DOCUMENTS

| | | | | | |
|---|---|---|---|---|---|
| 5,400,849 | A | * | 3/1995 | Sasaki et al. | 164/416 |
| 5,628,359 | A | * | 5/1997 | Legrand et al. | 164/428 |
| 5,915,454 | A | * | 6/1999 | Wright et al. | 164/428 |
| 6,032,722 | A | * | 3/2000 | Russell et al. | 164/428 |
| RE37,214 | E | * | 6/2001 | Barbe et al. | 164/428 |
| 2002/0011324 | A1 | * | 1/2002 | Capotosti et al. | 164/480 |

FOREIGN PATENT DOCUMENTS

| | | |
|---|---|---|
| EP | 546 206 | 6/1993 |
| EP | 575 617 | 12/1993 |
| EP | 714 715 | 6/1996 |

OTHER PUBLICATIONS

Patent Abstracts of Japan, vol. 017, No. 155, Mar. 26, 1993 & JP 04 322849 Nov. 12, 1992.

Patent Abstracts of Japan, vol. 013, No. 289, Jul. 5, 1989 & JP 01 083337, Mar. 29, 1989.

* cited by examiner

*Primary Examiner*—M. Alexandra Elve
*Assistant Examiner*—Kevin McHenry
(74) *Attorney, Agent, or Firm*—Sughrue Mion, PLLC

(57) ABSTRACT

The invention concerns a device for pressing a side wall (1) of an installation for continuous casting of metal strips between two cooling drums with horizontal axes against the planar surfaces of the cylinders, comprising three thrust member connected to a mounting frame (3) maintained in a fixed position, exerting their action on the rear face of a plate (2) on the front face whereof is fixed the side wall (1) or on the rear face of the side wall (1), said action being oriented along a substantially horizontal direction (Oy) parallel to the axes of the drums and being exerted via means connecting each of said thrust members on said plate. Said connection means of a first thrust member enable a relative displacement in translation of said thrust A-4 member and of the plate (2) or of the side wall (1) being along a horizontal direction (Ox) a=parallel to the plane of the planar surfaces of the drums and along a vertical direction (Oz) parallel to the plane of the planar surfaces of the drums. Said connection means of a second thrust member enable a relative displacement in translation of said thrust member and of the plate (2) or of the side wall (1) along-a horizontal direction (Ox) parallel to the plane of the planar surfaces of the drums. Said connection means of a third thrust member do not enable any relative displacement in translation of said thrust member and the plate (2) or of the side wall (1).

9 Claims, 1 Drawing Sheet

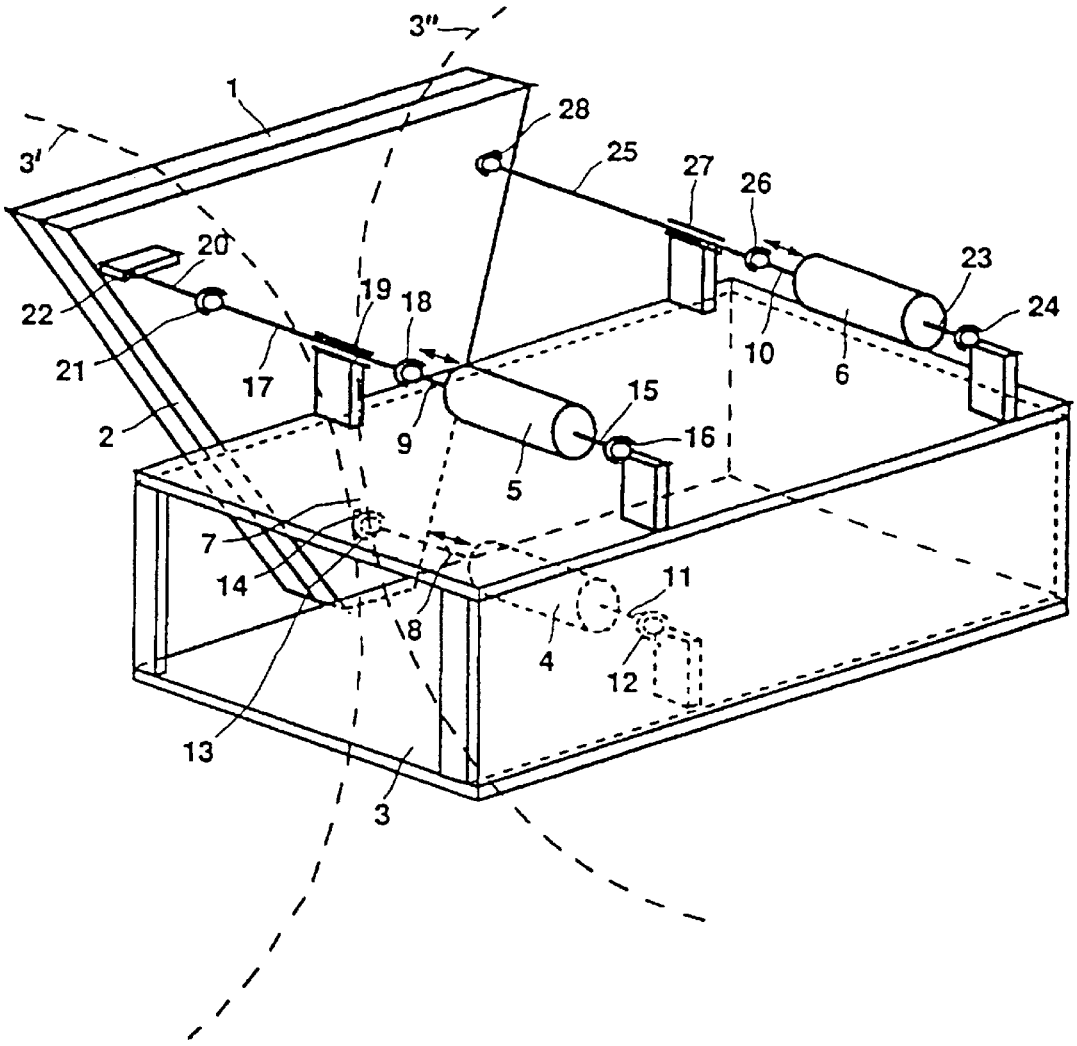
Single figure
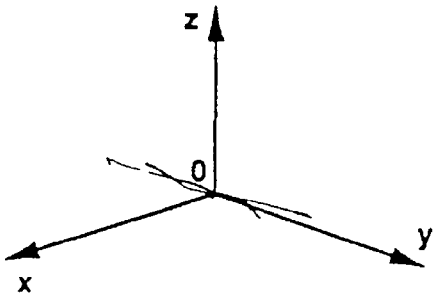

DEVICE FOR PRESSING A SIDE WALL IN INSTALLATION FOR CONTINUOUS CASTING OF METAL STRIPS BETWEEN TWO DRUMS AGAINST THE PLANAR SURFACES OF THE DRUMS

The invention relates to the continuous casting of metals. More specifically, it relates to casters for casting thin metal strip directly from liquid metal, of the type called "twin-roll casters".

These casters comprise, in the usual manner, two rolls having horizontal axes, the cylindrical lateral surfaces of which are placed side by side at a minimum distance corresponding to the thickness of the strip that it is desired to obtain. They thus define a casting space which is closed off laterally by two plates made of refractory material, called "side walls", mounted on a rigid metal baseplate and applied against the plane ends of the rolls. The peripheral surfaces of the rolls are made of a material having a high thermal conductivity (such as copper and copper alloys) and are internally cooled in a vigorous manner.

Each of these side walls is held in position by means of an assembly generally comprising a plurality of members which press it against the rolls with a force at least sufficient to prevent liquid metal from exfiltrating from the casting space. These members are mounted on a frame and comprise rigid rods which are fastened to the rear face of the baseplate to which the side wall is fastened and which are mounted on thrust springs, or controlled cylinders, or a combination of spring-loaded rods and controlled cylinders. These thrust members are, for example, three in number, distributed in the following manner. One of them exerts its action in the longitudinal mid-plane of the side wall and in its lower part, at a level close to the nip, that is to say the region where the rolls are closest together. The other two thrust members exert their action in the upper part of the side wall, at symmetrical points with respect to its longitudinal mid-plane. The thrust forces are thus distributed over the side wall so that a pressure sufficient to prevent exfiltration of liquid metal from the casting space can be exerted on all the regions of contact between the side wall and the ends of the rolls. However, this pressure must not be too high for fear of causing rapid wear of those parts of the side wall which rub against the rolls, which would severely limit the duration of the casting run. Documents JP-A-04322849 and EP-A1-0698433 are representative of this prior art. The thrust members and their means of connection to the frame and to the side wall are all identical thereto.

Because of the high temperature of the liquid metal (about 1500 to 1550° C. in the case of steel), the members for supporting the side walls are subjected to intense thermal stresses. It is therefore necessary to cool at least the baseplate, by means of an internal circulation of water, so as to limit the deformations and expansions of the support members. However, it is not possible to completely eliminate the expansions, and experience shows that even minute expansions can disturb the operation of the thrust members. This is particularly so when these thrust members consist of controlled cylinders which are more rigid than spring-loaded rods and therefore less able to damp the variations in the position of the points on the side wall against which their forces are mainly exerted. These expansions that the thrust members must absorb can falsify the information that they receive and the actions that they transmit to the side wall, or may even contribute to damaging them.

The object of the invention is to propose a design of a device for holding and applying the side walls against the end faces of the rolls, allowing the thrust members to exert their action without this being disturbed by the differential expansions of those parts of the device that are exposed to a high temperature.

For this purpose, the subject of the invention is a device for applying a side wall of a caster for the continuous casting of thin metal strip between two rotating cooled rolls having horizontal axes against the plane faces of the rolls, of the type comprising three thrust members connected to a frame held in a fixed position, which exert their actions on the rear face of a baseplate to the front face of which the side wall is fastened or on the rear of the side wall, the said action being exerted via means for connecting each of the said thrust members to the said baseplate or to the side wall, characterized in that the said means for connecting a first thrust member allow translational relative movement between the said thrust member and the baseplate or the side wall both in a horizontal direction parallel to the plane of the plane faces of the rolls and in a vertical direction parallel to the plane of the plane faces of the rolls, in that the said means for connecting a second thrust member allow translational relative movement between the said thrust member and the baseplate or the side wall in a horizontal direction parallel to the plane of the plane faces of the rolls and in that the said means for connecting the third thrust member allow no translational relative movement between the said thrust member and the baseplate or the side wall.

Preferably, the first thrust member exerts its action on the lower part of the baseplate or of the side wall, while the second and third thrust members exert their actions on the upper part of the baseplate or of the side wall.

As will have been understood, the invention consists in connecting the baseplate supporting the side wall (or the side wall itself if no baseplate is used to support it) to the three thrust members while allowing two of the three connections the possibility of moving in a plane parallel to the plane of the plane faces of the rolls against which the side wall is applied, from a point kept fixed. In this way, the baseplate or the side wall can expand freely without this expansion disturbing the actions of the thrust members, and good rigidity of the linkages between the various parts of the side wall and its support means is maintained. In particular, the action of the lower cylinder is made independent of those of the two upper cylinders and the actions of the two upper cylinders are made independent of each other.

The invention will be more clearly understood on reading the description which follows, given with reference to the single appended figure, which shows schematically, seen in perspective, an example of a device for applying a twin-roll caster side wall according to the invention.

The side wall 1 made of refractory material is fastened to a metal baseplate 2 and applied against the plane ends of the casting rolls (the outlines 3', 3" of which are shown by the dashed lines) by the device which will be described below. The side wall 1 and the baseplate 2 are illustrated very schematically, the precise way in which they are constructed being of no importance to the invention. The rest of the description will be given with reference to a coordinate system Oxyz in which the directions Ox and Oz are respectively the horizontal and vertical directions lying in the plane defined by the plane faces of the rolls or by the side wall 1 and the direction Oy is the horizontal direction perpendicular to the said plane, and therefore parallel to the axes of the rolls.

The device for applying the side wall 1 according to the invention comprises a fixed frame 3. This frame 3 is mounted on a movable trolley (not illustrated) which allows it to be moved, as required, closer to or further away from the rolls, when positioning the side wall 1 before the start of the casting run and removing the side wall 1 after the end of the casting run. The frame 3 and the baseplate 2 are connected by means of three controlled cylinders 4, 5, 6. The first cylinder 4 exerts its action in the longitudinal mid-plane of the side wall 1 and in its lower part, at a level close to that of the nip 7. The second cylinder 5 and the third cylinder 6 exert their actions in the upper part of the side wall 1, at symmetrical points with respect to its longitudinal mid-plane, to the left and to the right of the said plane, (in the example illustrated). These cylinders 4, 5, 6 are controlled, in a known manner, by a device (not illustrated) comprising computing means which govern the movements of their respective movable rods, so as to move them closer to or further away from the rolls, and the forces applied to the same rods. As is conventional, the cylinders 4, 5, 6 may be controlled in accordance with the intensity of the forces absorbed by the said movable rods 8, 9, 10 during application of the side wall 1 against the rolls, by means of the information gathered by sensors designed for this purpose.

According to the invention, the connection devices between the frame 3, the cylinders 4, 5, 6 and the baseplate 2 are constructed so as to allow the various members involved various degrees of freedom.

The first cylinder 4 is connected to the frame 3 via a fixed rod 11. This is articulated to the frame 3 by means of a ball joint 12 which allows the fixed rod 11 to rotate freely about its point of connection to the frame 3 in all directions in space. The movable rod 8 of the first cylinder 4 is connected directly to the baseplate 2, and this connection is also made by means of a ball joint 13 which allows the movable rod 8 to rotate freely about its point of connection 14 to the baseplate 2 in all directions in space. The result of this articulation of the linkage between the baseplate 2 and the frame 3 is that the connection point 14 can move freely in space in the directions Ox and Oz, especially according to the expansions and deformations of the baseplate 2, without this disturbing the operation of the first cylinder 4. In particular, the forces absorbed by the movable rod 8 will always be directed along its longitudinal axis. Should the connection point 14 move, it would simply be necessary for the device for controlling the first cylinder 4 to make the movable rod 8 move forwards or backwards so as to control the position of the connection point 14 on the Oy axis. The control point for maintaining the force absorbed by the movable rod 8 at a constant value makes it possible for this forward movement or this backward movement to be carried out automatically without additional special conditions with respect to the known control devices.

The second cylinder 5 is connected to the frame 3 via a fixed rod 15. The latter is articulated to the frame 3 by means of a ball joint 16 which allows the fixed rod 15 to rotate freely about its point of connection to the frame 3 in all directions in space. The end of the movable rod 9 is itself connected to one end of a rigid rod 17 via a ball joint 18. The rigid rod 17 slides in a slideway 19 fastened to the frame 3. This slideway 19 has the function of allowing the rod 17 to move only in the direction Oy. The other end of the rigid rod 17 is fastened to one end of another rigid rod 20 by means of a ball joint 21. The other end of this rigid rod 20 is inserted into a slideway 22 fastened to the baseplate 2 and oriented horizontally in the direction Ox. Its function is to allow relative movement between the baseplate 2 and the rigid rod 20 in the direction Ox and only in this direction, especially according to the expansions and deformations of the baseplate 2.

The third cylinder 6 is connected to the frame 3 via a fixed rod 23. The latter is articulated to the frame 3 by means of a ball joint 24 which allows the fixed rod 23 to rotate freely about its point of connection to the frame 3 in all directions in space. The end of the movable rod 10 is itself connected to one end of a rigid rod 25 via a ball joint 26. The rigid rod 25 slides in a slideway 27 fastened to the frame 3. The function of this slideway 27 is to allow the rigid rod 25 to move only in the direction Oy. The other end of the rigid rod 25 is connected to the baseplate 2 via a ball joint 28. The latter allows the rod 25 to rotate freely about its point of connection to the baseplate 2, but prevents it from any translational mode of movement with respect to the baseplate 2. Consequently, for a given position of the movable rods 8, 9, 10 of the cylinders 4, 5, 6, the latter connection point constitutes the only point on the baseplate 2 which is constantly kept fixed in space. Because of the possibilities of movement which are presented to them by the various ball joints and slideways of the holding device, all the other points on the baseplate 2 can move freely in the Oxz plane, according to the expansions of the baseplate 2. As regards the movements and deformations of the side wall 1/baseplate 2 assembly having a component along Oy, these are absorbed or compensated for by movements of the movable rods 8, 9, 10 of the cylinders 4, 5, 6.

The reason for the invention is the fact that the possibilities of free movement in the various dimensions in space given to the various points on the baseplate 2 influence the behaviour of the three cylinders 4, 5, 6 in an independent manner. The lower cylinder 4 is not automatically influenced by the variations in the actions exerted by the upper cylinders 5, 6, and vice versa. Likewise, the left upper cylinder 5 is not automatically influenced by the variations in the actions exerted by the right upper cylinder 6, particularly in the case of expansions along Ox. The configuration of the invention makes it possible to achieve isostatism of the system formed by, on the one hand, the side wall 1 and its baseplate 2 and, on the other hand, its application device.

As a variant, the ball joints 12, 16, 24 via which the cylinders 4, 5, 6 are connected to the frame 3 may be mounted not directly on the said frame 3 but separated from it by spring-loaded devices which allow the corresponding cylinder to move backwards. This additional possibility of absorbing the variations in the position of the side wall 1 along Oy introduces a degree of flexibility in the operation of the application device in that it makes it possible to react more quickly to sudden stresses due, for example, to the infiltration of solidified metal between a roll and the side wall 1.

The ball joints 16, 18, 24 and 26 which flank the upper cylinders 5, 6 are, in principle, not absolutely essential for implementation of the invention since, because of the presence of the slideways 19, 27, the stresses that are exerted on the movable rods 9, 10 of the cylinders 5, 6 are directed only along Oy, as are the stresses that are exerted on the fixed rods 15, 23 which connect the cylinders 5, 6 to the frame 3. It would not be outside the scope of the invention for the rods 9 and 17 on the one hand, and the rods 10 and 25 on the other, to merge, and likewise for the ball joints 16 and 24 via which the cylinders 5, 6 are connected to the frame 3 to be omitted, this connection then becoming quite rigid. However, the presence of the ball joints 16, 18, 24 and 26 provides an additional safety factor by limiting the possibility of the cylinders 5, 6 being damaged and by making their operation reliable should the caster deform slightly due to the effect of high temperatures of its environment.

The controlled cylinders 4, 5, 6 may also be replaced by spring-loaded devices operating freely, without being externally slaved or controlled. The position of the side wall 1 along Oy can then be controlled by the operator merely with the aid of means for positioning the frame 3.

Further modifications may be made to the caster as described. In particular, it would be conceivable to omit the baseplate 2 and connect the thrust members directly to the rear of the side wall 1, as long as the latter had sufficient mechanical strength and rigidity at high temperature for this. Moreover, it is conceivable to place the connection means of the first thrust member (those having degrees of freedom along Ox and Oz) not at the bottom of the side wall 1, as described and illustrated previously, but in its upper part, by therefore exchanging their position with one, chosen at will, of the connection means of the second and third thrust members. The configuration described and illustrated is, however, preferable since placing the connection allowing movements along Oz on the axis of symmetry of the caster results in more satisfactory operation of the device. Furthermore, this makes the caster ergonomically correct since, when mounting the baseplate, it easy to start by fitting it to the two fixed connections at the top as these are easily and simultaneously accessible, and then connecting the lower thrust member to the baseplate, and to carry out the reverse operation when dismantling the system.

The invention applies to twin-roll casters for all types of thin metal strip, for example strips made of steel, stainless steel and other ferrous alloys or of copper.

What is claimed is:

1. Device for applying a side wall (1) of a caster for the continuous casting of thin metal strip between two rotating cooled rolls having horizontal axes against plane faces of the rolls, of a type comprising three thrust members connected to a frame (3) held in a fixed position, which exert their actions on a rear face of a baseplate (2) to a front face of which the side wall (1) is fastened or on a rear of the side wall (1) itself, of said actions being directed in an approximately horizontal direction (Oy) parallel to, axes of the rolls and being exerted via means for connecting each of the said thrust members to the said baseplate, characterized in that the said means for connecting a first thrust member allow translational relative movement between the said thrust member and the baseplate (2) or the side wall (1) both in a horizontal direction (Ox) parallel to a plane of the plane faces of the rolls and in a vertical direction (Oz) parallel to the plane of the plane faces of the rolls, in that the said means for connecting a second thrust member allow translational relative free movement between the said thrust member and the baseplate (2) or the side wall (1) in a horizontal direction (Ox) parallel to the plane of the plane faces of the rolls and in that the said means for connecting the third thrust member allow no translational relative movement between the said thrust member and the baseplate (2) or the side wall (1).

2. Device according to claim 1, characterized in that the said means for connecting a first thrust member consist of a ball joint (13) into which is inserted a movable, rod (8) forming part of the said thrust member, said trust member also being fastened to the frame (3) by means of a ball joint (12)3.

3. Device according to claim 1, characterized in that the said means for connecting a second thrust member consist of a slideway (22) fastened to the baseplate (2) or the side wall (1) and directed horizontally along the said horizontal direction (Ox), a rigid rod (20), one end of which is inserted into the said slideway (22) and the other end of which is connected by a ball joint (21) to a rigid rod (17) forming part of the said second thrust member or being connected to it, the said rigid rod (17) passing through a slideway (19) directed along the said horizontal direction (Oy) and allowing the said rigid rod (17) to move only along the said horizontal direction (Oy).

4. Device according to claim 3, characterized in that the said means for connecting the third thrust member consist of a ball joint (28) fastened to the baseplate (2) or to the side wall (1) and a rigid rod (25) forming part of the said third thrust member or being connected to it, the said rigid rod (25) passing through a slideway (27) directed along the said horizontal direction (Oy) and allowing the said rigid rod (25) to move only along the said horizontal direction (Oy).

5. Device according to claim 4, characterized in that the said second and third thrust members are connected to the said rigid rods (17, 25) via ball joints (18, 26).

6. Device according to claim 4, characterized in that the said second and third thrust members are connected to the said frame (3) via ball joints (16,24).

7. Device according to claim 1, characterized in that the first thrust member exerts its action on a lower part of the baseplate (2) or of the side wall (1), while the second and third thrust members exert their actions on an upper part of the baseplate (2) or of the side wall (1).

8. Device according to claim 1, characterized in that the said thrust members are controlled cylinders (4, 5, 6).

9. Device according to claim 8, characterized in that the said cylinders (4, 5, 6) are connected to the said frame (3) via ball joints and spring-loaded devices allowing the corresponding cylinder to move backwards in the horizontal direction (Oy).

* * * * *